United States Patent [19]

Martin

[11] 4,346,484

[45] Aug. 31, 1982

[54] SWIMMING POOL INLET LOCATION CONTROL

[76] Inventor: John H. Martin, 1801-D Parkcourt Pl., Suite #104, Santa Ana, Calif. 92701

[21] Appl. No.: 187,617

[22] Filed: Sep. 15, 1980

[51] Int. Cl.[3] ..... E04H 3/19; E04H 3/18

[52] U.S. Cl. ..... 4/507; 4/490; 4/492; 134/167 R; 134/168 R

[58] Field of Search ..... 4/507, 492, 490, 508; 134/167 R, 168 R

[56] References Cited

U.S. PATENT DOCUMENTS

| | | | |
|---|---|---|---|
| 2,975,791 | 3/1961 | Pansini | 134/167 R |
| 3,433,237 | 3/1969 | Gelinas | 134/168 R |
| 3,577,571 | 5/1971 | Bellinson | 4/492 |
| 3,665,525 | 5/1972 | Howard | 134/168 R X |
| 4,289,155 | 9/1981 | Sable | 4/490 |

*Primary Examiner*—Henry K. Artis

[57] ABSTRACT

A swimming pool inlet location control is presented. The control comprises a flexible tube which is coupled between the prior art swimming pool inlet and the location where it is desired to bring in the incoming water. The flexible tube includes coupled to it a weight and a float which are utilized by the operator to place the inlet at exactly the point where it is desired. The tube includes a variable size quick release coupling means capable of coupling an adaptable to all pool return lines.

2 Claims, 2 Drawing Figures

SWIMMING POOL INLET LOCATION CONTROL

BACKGROUND OF THE INVENTION

1. Field of the Invention

The present invention relates to swimming pool inlet location control retrofit devices, which are capable of coupling to any existing swimming pool water inlet and coupling that water to any desired point in the swimming pool.

2. Description of the Prior Art

Because of the costs of construction, return lines to return water to swimming pools generally terminate no more than six inches beneath the water surface. When a heater is operational, the heated water is put into the pool on the top. Hot water, being lighter than cold water, the hot water stays there. A typical home swimming pool will have two water inlets, one in the shallow end, and one in the deep end, and both approximately six inches beneath the water surface level. While this keeps pool construction costs down, it vastly increases pool heating energy requirements.

The main drain on the bottom of the pool takes perhaps ten percent of the water which is removed from the pool. The other 90 percent of the water removed from the pool recirculates through the skimmer in order to remove floating debris from the top of the pool. Accordingly, when the pool is heated, 90 percent of the water removed from the pool to be sent to the heater is the very warm water from the top of the pool. There is very little mixing, and a pool which is very warm at the top may well be cold at the bottom. This causes swimming pool owners to keep their pools heated to a higher temperature than is necessary. In addition, because the heated water is at the top and insulates the cold water from the air, rather than vice versa, water evaporation from the pool is substantially higher than it would be if the pool were of more uniform temperature.

A model of the present invention has been submitted to the OERI department of the Department of Energy and in preliminary testing, according to the Department of Energy, has resulted in approximately 30 percent saving in energy over the widely used prior art system. This 30 percent saving in energy is even more important because solar systems are capable of generating a substantial amount of the energy required for a swimming pool. A solar system requires the use of heat boosting under certain conditions when there is not sufficient supplemental heat generated by the solar system. Since the present system increases efficiency, the 30 percent of the energy that it saves is more likely to be from that which would be necessary to be generated through the use of fuel, oil or natural gas or some other system rather than solar. In the case of a solar system supplemental heat, a system according to the present invention and according to the Department of Energy preliminary data would result in a substantially greater than 30 percent savings in energy.

Swimming pools also lose water through evaporation. A typical home sized swimming pool in the desert area with a prior art solar heating system would lose approximately 1,700 gallons of water from the pool per week. A system according to to the present invention, and according to test results would reduce this result to 500 or 600 gallons per week by reducing the surface temperature of the water.

In hot areas, solar systems can be used to cool the pool. For example, in the Phoenix area, swimming pools get uncomfortably hot, between 100° to 108°, depending on the temperature, during the early summer months. Running of a solar system in reverse at night cools the pool because the night time temperature may well drop to 80° or less while the day time temperature remains at substantially over 100°. Cooling the pool reduces the water loss through evaporation with consequent savings to the pool owner. Cooling the pool with the system according to the present design in comparison to the prior best solar cooling system reduces chemical loss and results in a 20 percent reduction in the amount of chemicals which need to be put into the pool from approximately $200.00 worth of chemicals per month in a desert area to $150 per month.

The preceding advantages accrue from reducing the surface temperature of the pool while maintaining the temperature at lower depths at the same comfortable temperature.

SUMMARY OF THE INVENTION

A swimming pool water inlet location control retrofit device is presented. A first example of the device includes a variable size quick release connector means having an inlet of varying size capable of removably coupling to any prior art pool return line water exit. The coupling is substantially leak-proof. As a safety device, and in order to comply with certain code sections in certain states, the coupling means automatically releases if water pressure therein exceeds a preselected pressure, which in this first example is 40 pounds per square inch.

The quick release connector means couples the prior art pool return line water exit to a first open end of a flexible tube fabricated from an impervious material such as polyvinylchloride. The tube has a second open end through which water exits from the tube into the swimming poll after the water has been heated, cooled, filtered, or otherwise treated.

A float is coupled in a removable coupling near the second end of the tube. A weight is also coupled in a removable coupling near the second end of the tube. The weight negative buoyancy and coupling location on the tube and the float positive buoyancy and coupling location on the tube are selected so as to select the depth at which the second tube exit is retained in the water of the swimming pool. If the weight negative buoyancy exceeds the positive buoyancy of the float, the weight has the capacity to pull the float under water. The tube will then extend from the coupling means at the prior art pool return water exit substantially straight downward to the weight, if the weight is placed between the float and the coupling means. The float will then cause the end of the tube to rise substantially vertically from the weight a distance substantially equal to the distance between the float and the weight. The water will exit in an upward direction.

An alternative system comprises a float having a positive buoyancy greater than the negative buoyancy of the weight. The float is then coupled to the tube at a position intermediate between the weight which is at the second end of the tube and the coupling end. The float floats and the tube hangs substantially vertically down from the tube. In this system the water exit direction is substantially straight down. If a smaller float than weight is used, the water exit direction will be substantially straight up.

DETAILED DESCRIPTION

Figure 1:
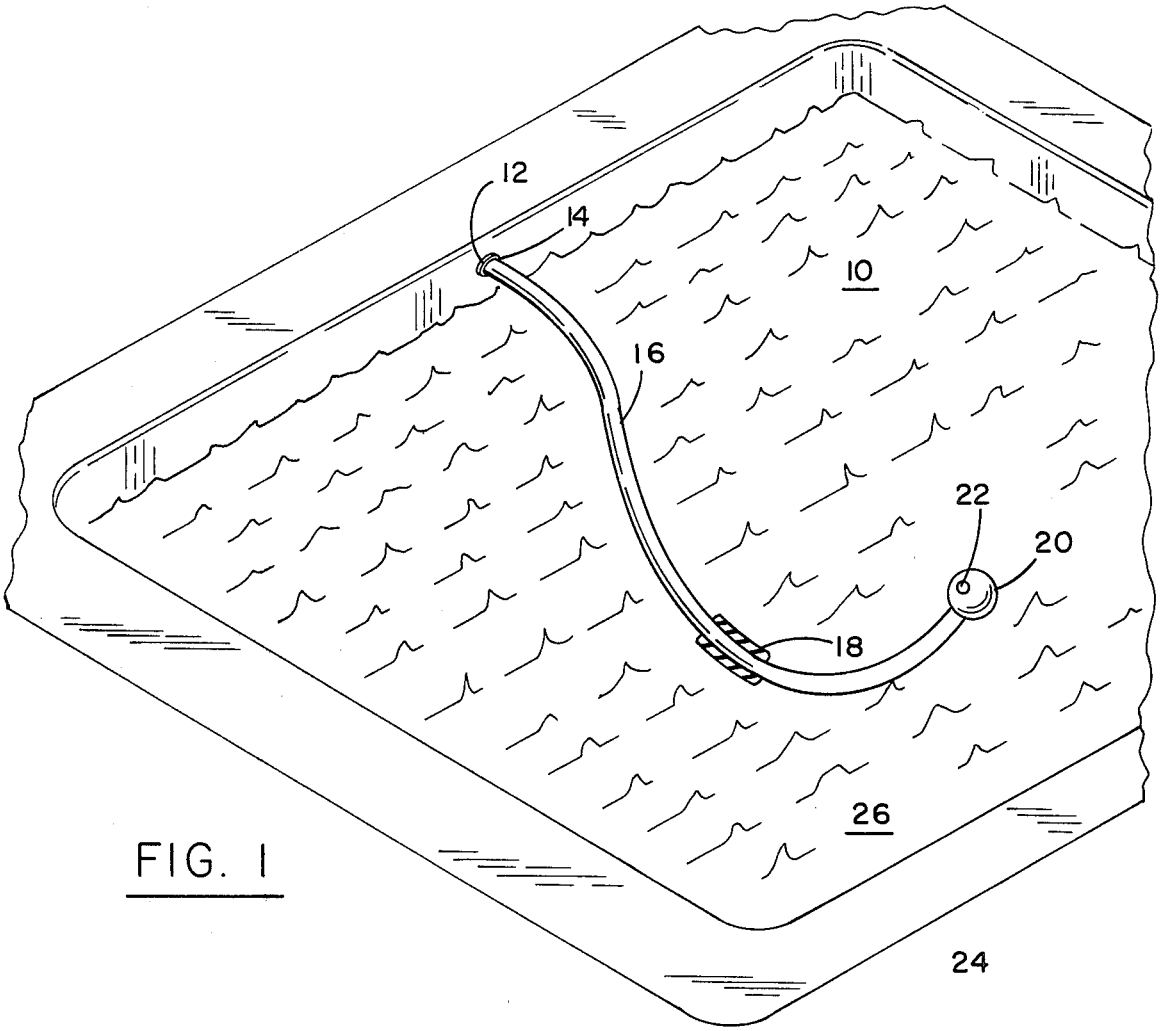
Figure 2:
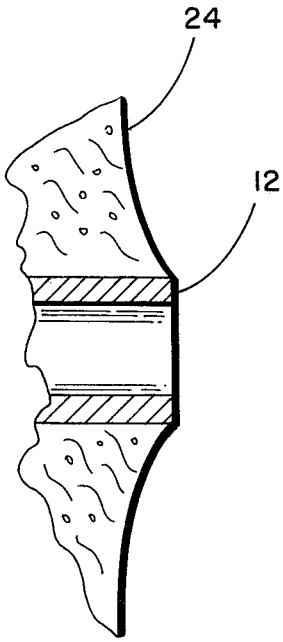
Figure 2:
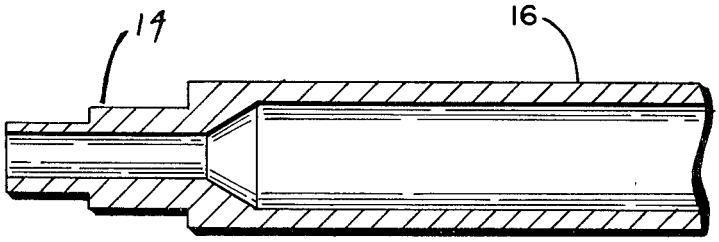

Reference should be made at this time to FIGS. 1 and 2 which illustrate an example of a swimming pool water inlet selective variable location control retrofit device 10 according to the present invention.

The device 10, also referred to as a swimming pool inlet location control 10, couples to a prior art water outlet 12 from which water is returned to the pool from the heater, filter, etcetera. Coupling means 14 are used to couple a first end of a tube 16 to the prior art water outlet 12 in a substantially leak-proof coupling. The tube 16 is flexible and fabricated from an impervious material such as polyvinylchloride and has two open ends. The first open end is coupled to the coupling means 14 in a substantially leak-proof coupling.

The coupling means 14 in the present example comprises a variable size quick release safety coupling means. By variable size is meant that the coupling means 14 can couple to any of the known sizes of prior art water outlets 12. Quick release refers to a particular type of release system which makes it very convenient to connect and disconnect the coupling means 14 from the prior art water outlet 12. The safety device comprises means to automatically uncouple the coupling means 14 from the prior art water outlet 12 when water pressure therein exceeds a preselected pressure such as 40 pounds per square inch.

The location of the second exit 22 of the tube 16 in water 26 in a swimming pool 24 is determined by the size and placement of a weight 18 and float 20. In a first example, the negative buoyancy of the weight 18 exceeds the positive buoyancy of the float 20 so that the weight 18, when attached to the float 20 will take the float 20 under water 26.

In the first example, the float 20 is coupled substantially at the tube exit 22 and the weight 18 is coupled between the float 20 and the coupling means 14 but closer to the float 20. The weight 18 then sinks as far as possible, limited only by the distance between the weight 18 and the coupling means 14. The float 20 then causes the second end of the tube 16 also known as the tube exit 22 substantially straight above the weight 18. In this configuration, the tube exit 22 is pointing substantially straight up and the water exiting the tube exits in the direction going substantially straight up. For more complicated control of the tube exit 22 location and orientation, a plurality of weights 18 and floats 20 are required to be used. The exiting of the water from the tube exit 22 has a jet effect which tends to force the tube exit 22 end of the tube 16 away from the direction of water flow out of the tube exit 22. By taking this into account, and varying the size and location of a plurality of weights 18 and floats 20, for most cases, two of each are sufficient, greater control of the direction of water exit from the tube exit 22 can be achieved.

In a second example of the invention, the buoyancy of the float 20 exceeds the negative buoyancy of the weight 18. In this case, the weight 18 is coupled to the tube exit 22 and the float 20 is coupled to a place along the tube between the tube exit 22 and the coupling means 14. The float 20 will float, as will that portion of the tube 16 between the float 20 and the coupling means 14. The weight 18 and the tube exit 22 will go in a direction substantially straight down from the float 20. The direction of water flow out of the tube exit 22 will be substantial straight down. Such a system is useful when it is desired to have water enter the swimming pool at a point not directly beneath the prior art water outlet 12 into the swimming pool 24. Swimming pool water inlet is the location where water is received by the pool 24. This may be the prior art water outlet 12, or if a location control 10 is coupled to the outlet 12, a tube exit 22.

A particular example of the invention has been described. Other examples will be obvious to those skilled in the prior art. The invention is limited only by the following claims.

I claim:

1. A swimming pool water inlet selective variable location control retrofit device, comprising:

a tube fabricated from an impervious material such as polyvinylchloride and having two open ends;

removable coupling means coupling the first end of the tube in a substantially leak-proof coupling to a prior art pool return line water exit;

a float coupled in a removable coupling near the second end of the tube; and a weight, coupled in a removable coupling near the second end of the tube, the weight negative buoyancy and coupling location on the tube and float positive buoyancy and coupling location on the tube selected so as to select the depth at which the second tube exit is retained in the water of the swimming pool.

2. The invention of claim 1, wherein:

the tube is flexible;

the coupling means is of selectively variable size, quick release, and automatically released if water pressure exceeds a preselected pressure;

the weight negative buoyancy exceeds the positive buoyancy of the float which float is coupled very close to the tube exit; and the depth of the water inlet is selectively determined by the length of the tube, the distance from the tube exit at which the weight is coupled to the tube, and the depth at which the coupling means is coupled to the prior art water outlet.

* * * * *